US007917072B2

(12) United States Patent
Torimaru

(10) Patent No.: US 7,917,072 B2
(45) Date of Patent: Mar. 29, 2011

(54) IMAGE FORMING APPARATUS AND BELT TRANSPORTING APPARATUS WITH MOVING MEMBER

(75) Inventor: Satoru Torimaru, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 512 days.

(21) Appl. No.: 12/031,230

(22) Filed: Feb. 14, 2008

(65) Prior Publication Data

US 2009/0087232 A1 Apr. 2, 2009

(30) Foreign Application Priority Data

Sep. 28, 2007 (JP) ..... 2007-255286

(51) Int. Cl.
*G03G 15/16* (2006.01)

(52) U.S. Cl. ..... 399/313

(58) Field of Classification Search ..... 399/313, 399/302, 308, 297, 303, 312
See application file for complete search history.

(56) References Cited

U.S. PATENT DOCUMENTS 6,445,900 B2 * 9/2002 Fukao et al. ..... 399/302

FOREIGN PATENT DOCUMENTS

JP 2006-267587 10/2006
JP 2006-267704 10/2006

OTHER PUBLICATIONS

Translation of JP2006-267704, May 10, 2006.*

* cited by examiner

*Primary Examiner* — Quana M Grainger
(74) *Attorney, Agent, or Firm* — Morgan, Lewis & Bockius LLP

(57) ABSTRACT

The image forming apparatus is provided with: an image carrier that holds an image; an endless transfer belt that is rotated while sandwiching a recording medium therebetween, and transfers the image on the image carrier to the recording medium; a first roll member that holds the transfer belt and brings that into contact with the image carrier; a second and third roll members that hold the transfer belt together with the first roll member; and a moving member that makes the second roll member movable so as to make a center distance between the first and second roll members on one end side of the transfer belt larger than one on the other end side, and makes the third roll member movable so as to make a center distance between the first and third roll members on the one end side smaller than one on the other end side.

19 Claims, 9 Drawing Sheets

FIG.3B INNER SIDE
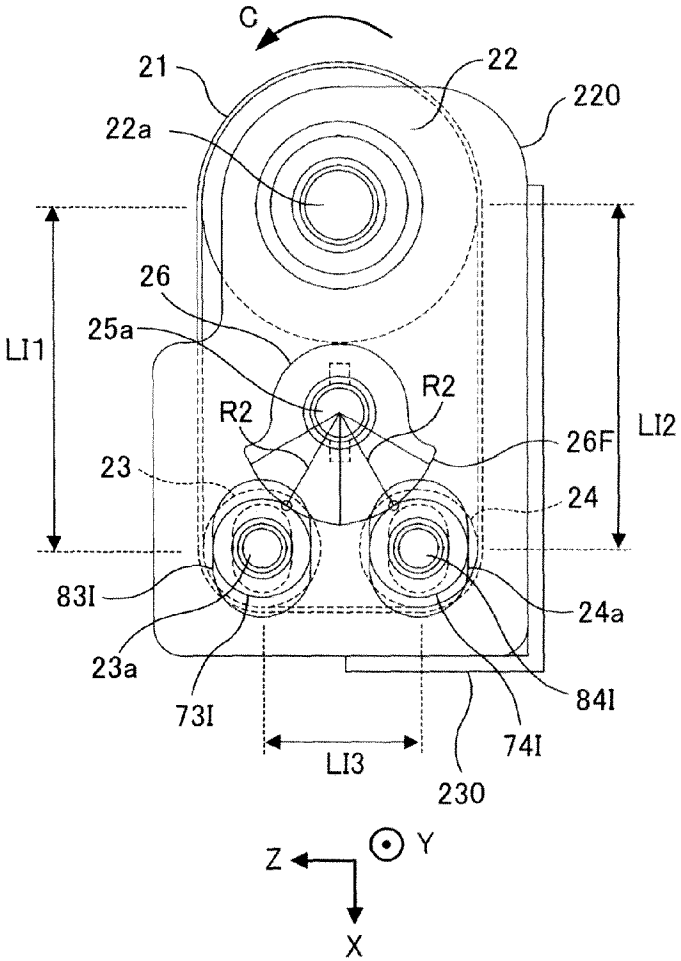
FIG.3A OUTER SIDE
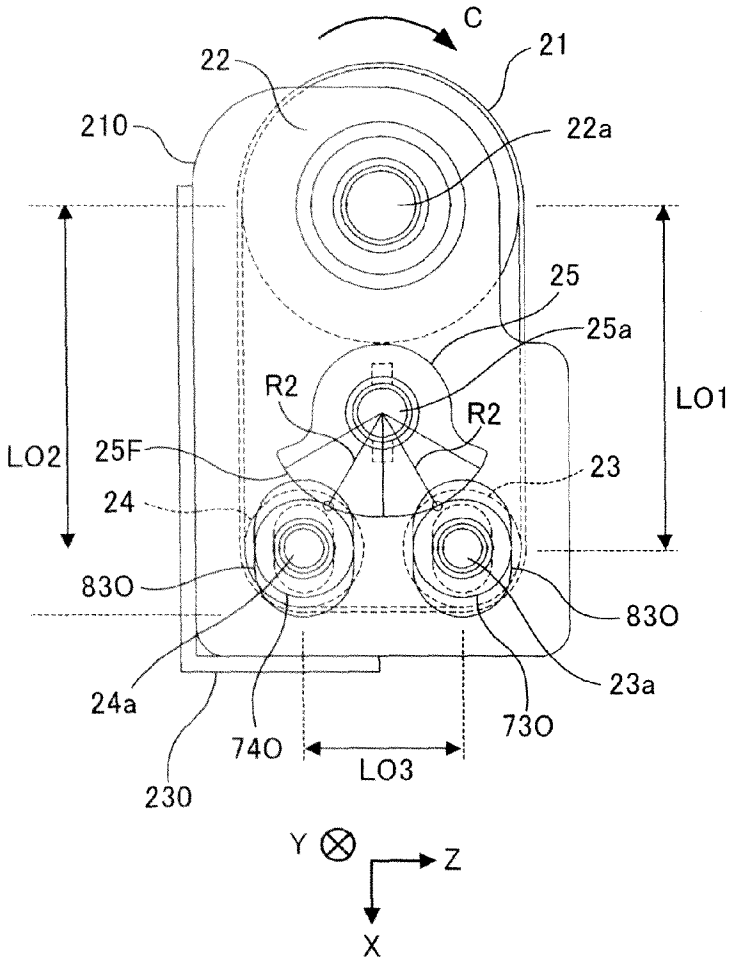

FIG.6B INNER SIDE
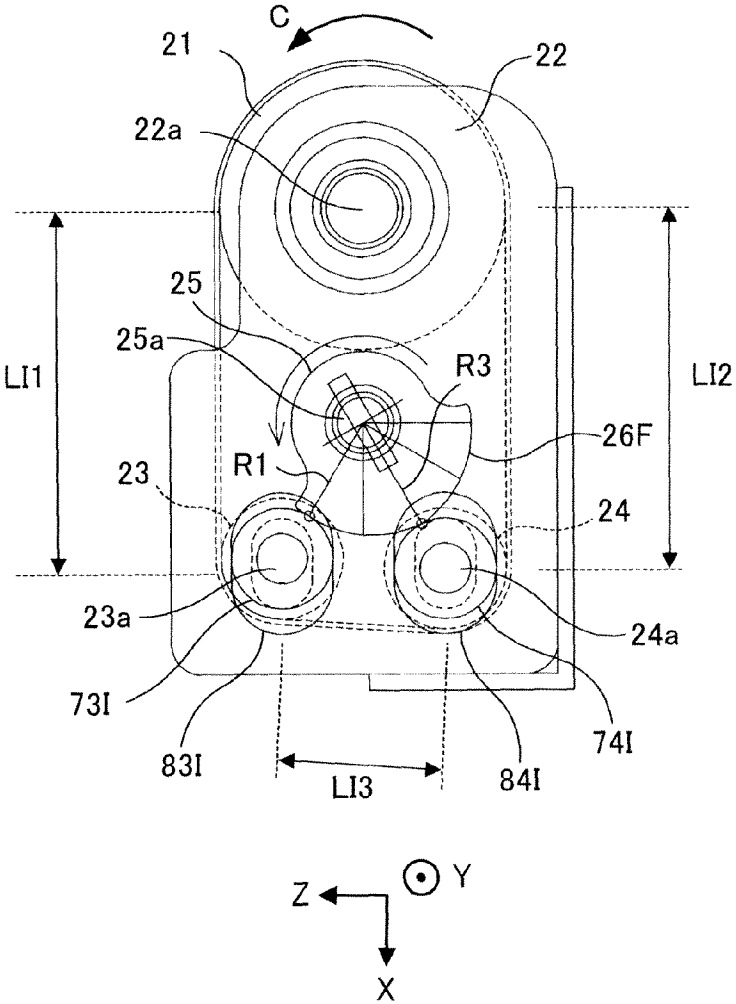
FIG.6A OUTER SIDE
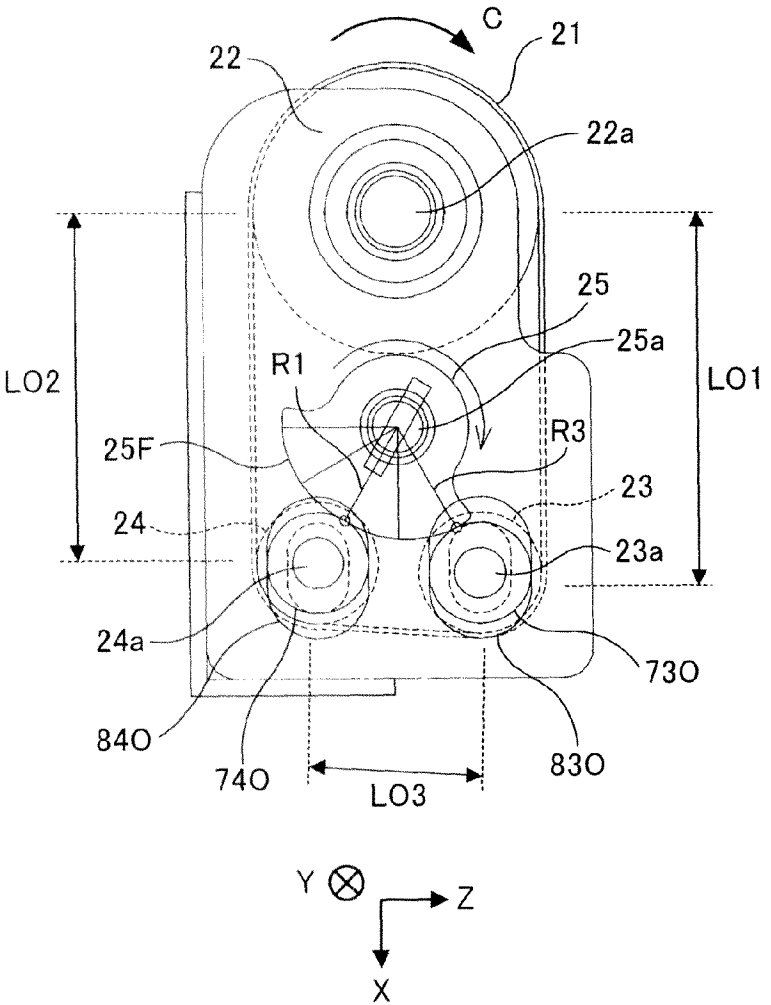

FIG.8B INNER SIDE
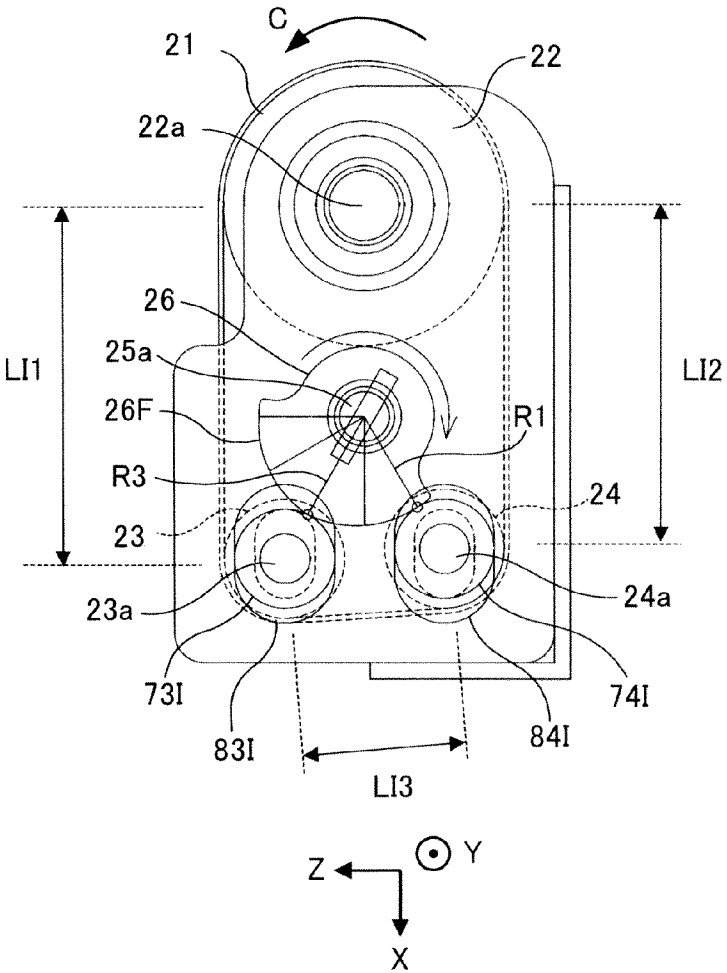
FIG.8A OUTER SIDE
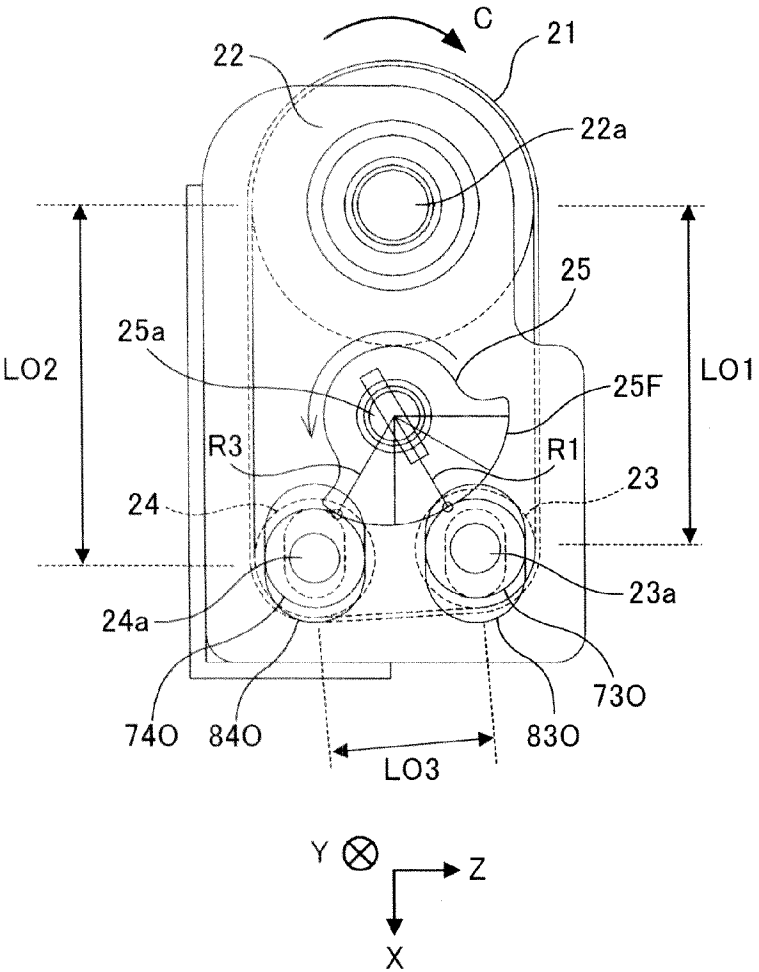

IMAGE FORMING APPARATUS AND BELT TRANSPORTING APPARATUS WITH MOVING MEMBER

CROSS REFERENCE TO RELATED APPLICATIONS

This application is based on and claims priority under 35 USC §119 from Japanese Patent Application No. 2007-255286 filed Sep. 28, 2007.

BACKGROUND

1. Technical Field

The present invention relates to an image forming apparatus and a belt transporting apparatus.

2. Related Art

For example, in an image forming apparatus employing an electrophotographic method, a transfer apparatus that transfers an image held by an image carrier such as a photoconductor and an intermediate transfer body to a recording medium such as a sheet is used.

SUMMARY

According to an aspect of the invention, there is provided an image forming apparatus including: an image carrier that holds an image; an endless transfer belt that is rotated while a recording medium is sandwiched between the transfer belt and the image carrier, and transfers the image held by the image carrier to the recording medium; a first roll member that holds the transfer belt and brings the transfer belt into contact with the image carrier; a second roll member that holds the transfer belt together with the first roll member; a third roll member that holds the transfer belt together with the first roll member and the second roll member; and a moving member that makes the second roll member movable so as to make a center distance between the first roll member and the second roll member larger on one end side of the transfer belt than the center distance on the other end side, and makes the third roll member movable so as to make a center distance between the first roll member and the third roll member smaller on the one end side than the center distance on the other end side.

BRIEF DESCRIPTION OF THE DRAWINGS

Exemplary embodiment (s) of the present invention will be described in detail based on the following figures, wherein:

FIGS. 3A and 3B are side views of the secondary transfer unit shown in FIG. 2;

FIGS. 6A and 6B are diagrams for explaining motions in the secondary transfer unit when the image on the outer side is elongated;

FIGS. 8A and 8B are diagrams for explaining motions in the secondary transfer unit when the image on the inner side is elongated.

DETAILED DESCRIPTION

Hereinafter, exemplary embodiments of the present invention will be described in detail with reference to the attached drawings.

Figure 1:
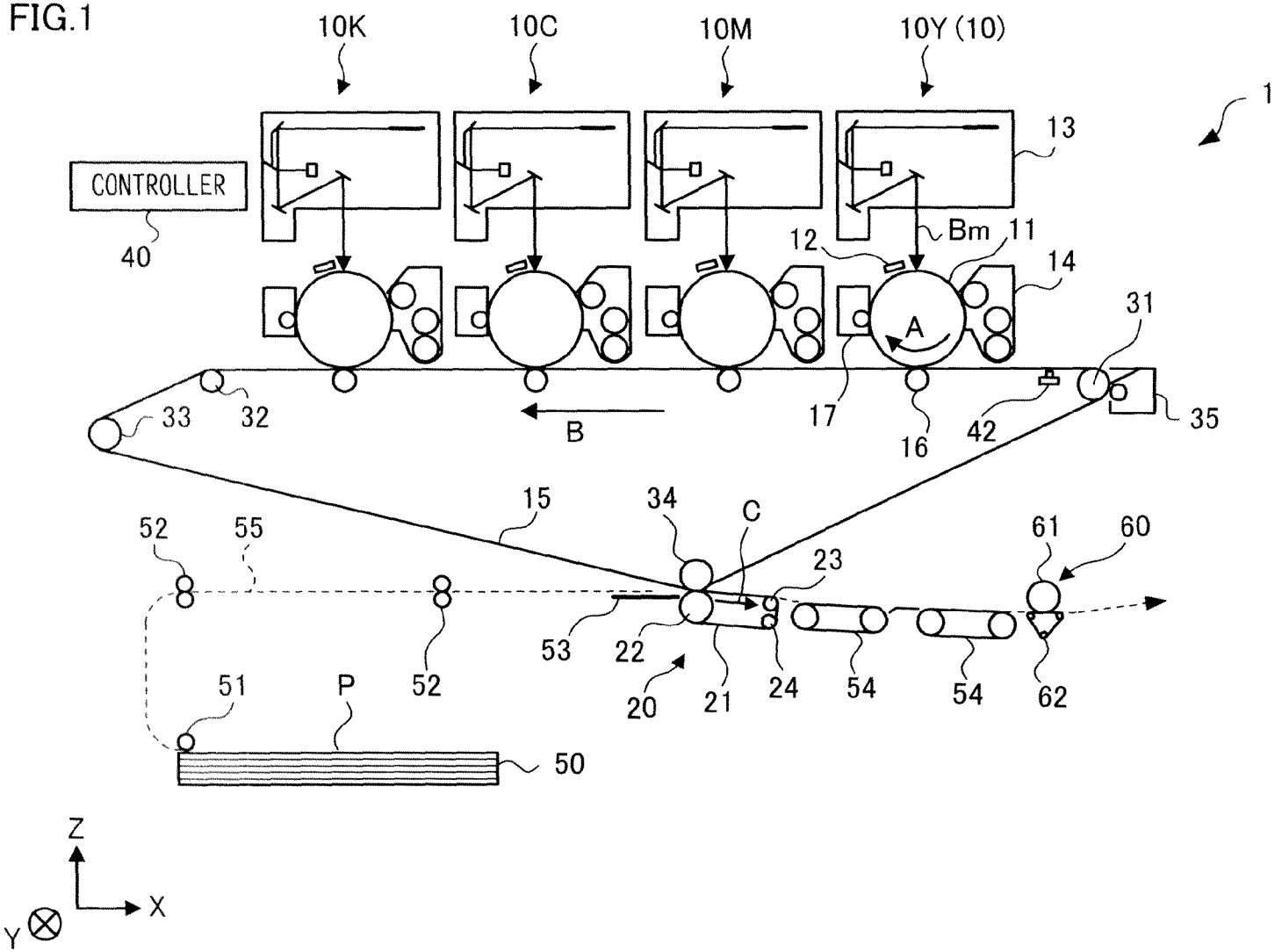
FIG. 1 is a diagram that illustrates an image forming apparatus to which the exemplary embodiment is applied.

FIG. 1 is a diagram that illustrates an image forming apparatus 1 to which the exemplary embodiment is applied. Incidentally, in the FIG. 1, a X direction (a right-and-left direction on paper), a Y direction (a front-and-back direction on the paper) and a Z direction (an up-and-down direction on the paper) relative to the image forming apparatus 1 are shown as arrows. These directions are shown in subsequent drawings as necessary.

The image forming apparatus 1 shown in FIG. 1 is what is termed a tandem-type, or an intermediate-transfer-type image forming apparatus. The image forming apparatus 1 includes plural image forming units 10 (10Y, 10M, 10C, and 10K) in which toner images of respective color components are formed by electrophotographic manner, an intermediate transfer belt 15 that sequentially transfers (primarily transfers) the toner images of respective color components formed in the respective image forming units 10 and makes them held, a secondary transfer unit 20 in which the overlapped toner images having transferred to the intermediate transfer belt 15 are collectively transferred (secondarily transferred) to a paper sheet P, a fixing apparatus 60 that makes the image having been secondarily transferred to the paper sheet P fixed thereon, and a controller 40 that controls the operation of respective apparatus (respective units).

Note that, in the following, the image forming apparatus 1 will be described by providing the front side of the paper (front side) of the image forming apparatus 1 shown in FIG. 1 as an outer side and the back side of the space (rear side) as an inner side. Further, these outer and inner sides are tentatively expressed to specify one end of a driving roll 22 or the like in the secondary transfer unit 20 which will be described later.

Each of the image forming units 10 (10Y, 10M, 10C, and 10K) includes a photoconductor 11 that is rotated in a direction of an arrow A. Around the photoconductor 11, a charging unit 12 that electrically charges the photoconductor 11, a laser exposure unit 13 that makes an electrostatic image formed on the photoconductor 11 (an exposure beam is shown as a symbol Bm in FIG. 1), a developing unit 14 that stores toner of each color component and visualizes the electrostatic image on the photoconductor 11 by using the toner, a primary transfer roll 16 that transfers the toner image of each color component formed on the photoconductor 11 to the intermediate transfer belt 15, and a photoconductor cleaner 17 that removes toner remaining on the photoconductor 11 are sequentially arranged. These image forming units 10 is arranged in a substantially linear fashion, and the image forming units of yellow (10Y), magenta (10M), cyan (10C) and black (10K) are arranged in this order from the upstream side of the intermediate transfer belt 15.

The intermediate transfer belt 15 as one example of a image carrier is made of a resin, such as a polyimide, a polyamide or the like to which an appropriate dose of an antistatic agent such as carbon black is added, and is configured by a film-formed endless belt. The intermediate transfer belt 15 is driven to circulate at a predetermined velocity in a direction as indicated by an arrow B in FIG. 1 by a variety of rolls. These rolls include a driving roll 31 that is rotated by a motor (not shown in the figure) being excellent in running with a constant speed and drives intermediate transfer belt 15 to circulate, an idle roll 32 that supports the intermediate transfer belt 15 extending in a substantially linear shape along the direction in which the photoconductors 11 are arranged, a tension applying roll 33 that applies certain tensile force to the intermediate transfer belt 15, and prevents the intermediate transfer belt 15 from meandering, a backup roll 34 that is arranged so as to be opposed to a secondary transfer unit 20 while the intermediate transfer belt is sandwiched therebetween.

A voltage that has a polarity contrary to the charged toner is to be applied to each of the primary transfer rolls 16 opposed to the corresponding one of the photoconductors 11 and arranged inside the intermediate transfer belt 15 that extends in a substantially linear shape. Each of the toner images on the respective photoconductors 11 is thus adhered electrostatically to the intermediate transfer belt 15 one after another to form the overlapped toner images on the intermediate transfer belt 15.

The secondary transfer unit 20 is to transport a sheet P as a recording medium and to transfer secondarily a superimposed toner image formed on the intermediate transfer belt 15 to the sheet P. The secondary transfer unit 20 includes a secondary transfer belt 21 which functions as a transfer belt, the driving roll 22 which is as one of a first roll member and that is looped with the secondary transfer belt 21, an image adjustment roll 23 which is as one of the second roll member, and a belt adjustment roll 24 which is as one of roll members of the third roll member. The secondary transfer belt 21 is a so-called rubber belt whose material is an elastomer such as chloroprene. The driving roll 22 is to rotationally drive the secondary transfer belt 21. Further, the secondary transfer belt 21 is circularly driven in a direction of an arrow C shown in the figure at a predetermined speed by the driving roll 22. At this time, the image adjustment roll 23 and the belt adjustment roll 24 are driven and rotated by being transmitted a driving force from the driving roll 22 via the secondary transfer belt 21. Note that the respective driving roll 22, image adjustment roll 23 and belt adjustment roll 24 are positioned and held in a position by setting a virtual belt inner circumference formed by respective outer circumferences and tangents of the outer circumference longer than an inner circumference in a free state of the secondary transfer belt 21, by a self contractive force of the secondary transfer belt 21, and by being brought into contact with a side plate, a cam and a bearing portion in the secondary transfer unit 20 which will be described later.

Further, the backup roll 34 and the driving roll 22 in the secondary transfer unit 20 sandwich the intermediate transfer belt 15 to form a transfer nip portion (secondary transfer position).

Further, the driving roll 22 to which the present exemplary embodiment is applied is a roll member having a multilayered structure in which a semi-conductive (for example, volume resistivity is around the 105 to the 108) rubber foam layer (e.g. epichlorohydrin rubber or the like) is wrapped around a mandrel of a metal (e.g. SUS material). The driving roll 22 is a roll member which also serves as a function of a transfer roll (that applies transfer voltage or grounds on the earth). The material of the image adjustment roll 23 and the belt adjustment roll 24 is not necessary to be particularly specified, however, a roll of a metal having a small bending by the tension of a belt (e.g. SUS material) is preferable. Note that the secondary transfer unit 20 is provided with a cleaning mechanism (not shown in the figure) to clean the surface of the secondary transfer belt 21. Note that the above-described image adjustment roll 23 and belt adjustment roll 24 will be described in detail later.

Then, a belt cleaner 35 that is arranged so that the belt cleaner 35 and the driving roll 31 sandwiches the intermediate transfer belt 15 and the belt cleaner 35 is opposed to the driving roll 31, and removes residual toner and paper powder on the intermediate transfer belt 15 after secondary transfer and cleans the surface of the intermediate transfer belt 15 is attached on the downstream side relative to a secondary transfer position of the intermediate transfer belt 15. On the other hand, inside the intermediate transfer belt 15 on the upstream side relative to a yellow image forming unit 10Y, there is arranged a reference sensor 42 that generates a reference signal which is referenced to obtain image forming timing in each image forming unit 10. The reference sensor 42 recognizes a mark provided inside the intermediate transfer belt 15 (back side of an image holding face) to generate the reference signal. Each image forming unit 10 is configured so as to start image forming by a command from the controller 40 based on the recognition of the reference signal.

In the present exemplary embodiment, a paper sheet transportation system includes a paper sheet tray 50 that stores paper sheets P, and a feed roll 51 that takes one of the paper sheets P piled on the paper sheet tray 50 from the paper sheet tray 50 at certain timing and transports it to a transporting route 55. Further, the paper sheet transportation system includes transporting rolls 52 that transports a paper sheet P fed by the feed roll 51, a transportation guiding member 53 that feeds the paper sheet P transported by the transporting roll 52 into the secondary transfer position, transporting belts 54 that transport the paper sheet P transported by the secondary transfer belt 21 after the secondary transfer, to the fixing apparatus 60.

Further, the fixing apparatus 60 includes a heating roll 61 that incorporates a heating source (not shown in the figure) and is arranged rotatably, and a pressure belt 62 that is rotatably arranged by pressing against this heating roll 61. A high-releasable fluororubber layer is formed on the surfaces of the heating roll 61 and the pressure belt 62.

Subsequently, descriptions will be given of an image formation process in the image forming apparatus 1 of the present exemplary embodiment. Firstly, image data is outputted from an image-reading apparatus (not shown in the figure), a personal computer (PC) (not shown in the figure) or the like, and then is inputted into the image forming apparatus 1. In the image forming apparatus 1, the image processing is carried out on the data by an image processing apparatus (not shown in the figure), and then image forming operation is executed using the image forming units 10 and the like. In the image processing apparatus, the image processings are carried out on the inputted reflectance data. The image processings include various predetermined image editings such as shading correction, displacement correction, brightness/color-space conversion, gamma correction, border erasing, color editing, editing by moving and the like. The image data having been subjected to the image processings is converted into gradation data of four color materials of yellow (Y), magenta (M), cyan (C) and black (K), and the converted data is outputted to the laser exposure unit 13.

The laser exposure unit 13 irradiates the exposure beam Bm outputted from, for example, a semi-conductor laser, onto each of the photoconductors 11 of the image forming units 10. The surface of each of the photoconductors 11 of the image forming units 10 is electrically charged by the charging unit 12, and then scanned and exposed by the laser exposure unit 13 so as to form an electrostatic latent image. The formed electrostatic latent image is then developed as respective toner images of yellow (Y), magenta (M), cyan (C) and black (K) by the respective developing units 14 of the image forming units 10.

The toner images formed on the respective photoconductors 11 of the image forming units 10 are transferred onto the intermediate transfer belt 15 at respective primary transfer positions where the respective photoconductors 11 are brought into contact with the intermediate transfer belt 15. The images that have been thus primarily transferred and are then transported to the secondary transfer unit 20 as the intermediate transfer belt 15 rotates. Incidentally, residual toner remaining on the photoconductors 11 after the transfer to the intermediate transfer belt 15 is removed by the photoconductor cleaner 17.

On the other hand, in the paper sheet transportation system, the feed roll 51 rotates in accordance with the timing for image formation, and thus the paper sheet P of a predetermined size is supplied from the paper sheet tray 50. The paper sheet P supplied by the feed roll 51 is then transported along the transporting route 55 by the transporting rolls 52, and reaches the secondary transfer unit 20 via the transportation guiding member 53. Before the paper sheet P reaches the secondary transfer unit 20, the paper sheet P is stopped once, and an alignment of the positions of the paper sheet P and the toner image is achieved by rotating a resist roll (not shown in the figure) that adjusts the position of the paper sheet P, in accordance with the timing of the moving of the intermediate transfer belt 15 that holds the toner image as described above.

Then, the sheet P fed from a resist roll (not shown in the figure) is transported to the transfer nip portion to be formed between the driving roll 22 of the secondary transfer belt 21 and the backup roll 34 of the intermediate transfer belt 15 to be sandwiched between the intermediate transfer belt 15 and the secondary transfer belt 21. At this time, a transfer electric field is formed between the backup roll 34 and the driving roll 22 by applying a transfer voltage taking one as a transfer voltage applying electrode and the other as a counter electrode (earth). An unfixed toner image carried on the intermediate transfer belt 15 is electrostatically transferred on the sheet P. Note that an exemplary embodiment in which the driving roll 22 is served also as a power supply roll may be employed.

Thereafter, the sheet P on which the toner image is electrostatically transferred is transported as such in a state peeled off the intermediate transfer belt 15 by the secondary transfer belt 21, and the sheet P is transported to the transporting belt 54 provided on the downstream side in a sheet transporting direction of the secondary transfer belt 21. Here, since the secondary transfer belt 21 is used in the present exemplary embodiment, the sheet P which has passed through the secondary transfer position is hardly attached on the intermediate transfer belt 15 side and is apt to be transported in a state adsorbed on the secondary transfer belt 21 side. Further, the sheet P that is transported on the secondary transfer belt 21 is peeled off the secondary transfer belt 21 by a curvature of the image adjustment roll 23 holds the secondary transfer belt 21 near the image adjustment roll 23, and transported toward the further downstream side. The transporting belt 54 executes speed control so as to match it with a most suitable transporting speed of the fixing apparatus 60 to transport the sheet P to the fixing apparatus 60. The unfixed toner image on the sheet P transported to the fixing apparatus 60 is subjected to fixing processing with heat and pressure by the fixing apparatus 60 to be fixed on the sheet P. Then, the sheet P holding the fixed image is discharged outside the image forming apparatus 1 by a discharge roll (not shown in the figure). Further, after completion of transfer to the sheet P, the residual toner remaining on the intermediate transfer belt 15 is removed by the belt cleaner 35.

Figure 2:
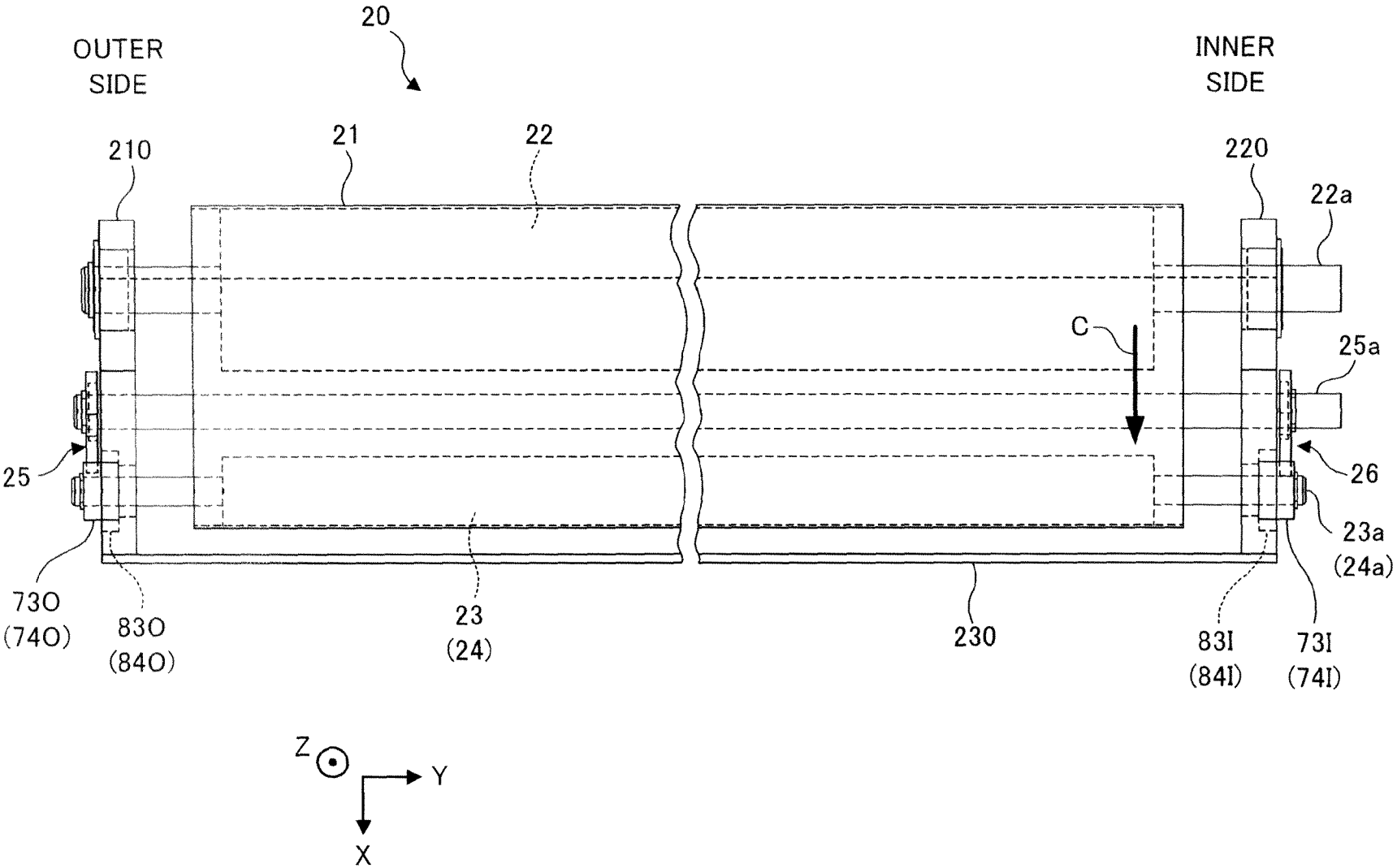
FIG. 2 is a diagram that illustrates the whole secondary transfer unit to which the present exemplary embodiment is applied.

FIG. 2 is a diagram that illustrates the whole secondary transfer unit 20 to which the present exemplary embodiment is applied. Note that FIG. 2 is a diagram viewing the secondary transfer unit 20 shown in FIG. 1 from the top, and there is shown a sheet transporting face side on the frontward side of the space. FIGS. 3A and 3B are side views of the secondary transfer unit 20 shown in FIG. 2.

FIG. 3A illustrates a side view of the outer side of the secondary transfer unit 20. FIG. 3B illustrates a side view of the inner side of the secondary transfer unit 20. Note that FIGS. 3A and 3B show a reference state (reference position of respective rolls) of the secondary transfer unit 20 which will be described later.

The secondary transfer unit 20 that functions as a belt transporting apparatus includes a function of adjusting a length in a sub-scanning direction on the outer and inner sides of the image on the sheet P when being secondarily transferred, and a function of suppressing meanders of the secondary transfer belt 21 which may occur associated with the adjustment, as described later.

As shown in FIG. 2, in the secondary transfer unit 20, the driving roll 22 includes a driving roll axis 22*a*, the image adjustment roll 23 includes an image adjustment roll axis 23*a*, and the belt adjustment roll 24 includes a belt adjustment roll axis 24*a* respectively. Further, there are provided a side plate 210 of the outer side on the outer side and a side plate 220 of the inner side on the inner side relative to these three rolls. Furthermore, there are provided a connection body 230 which connects the side plate 210 of the outer side and the side plate 220 of the inner side.

In addition, the rotation axes of these three rolls are held by the side plate 210 of the outer side and the side plate 220 of the inner side that are provided on both end sides.

A driving motor (not shown in the figure) is connected to the driving roll axis 22*a* in the outside of the side plate 220 of the inner side, and the driving roll 22 receives a power from the driving motor to rotate the secondary transfer belt 21.

As shown in FIG. 3, the image adjustment roll 23 is attached on the downstream side of the driving roll 22 in a direction of rotation C of the secondary transfer belt 21. Further, in the present exemplary embodiment, a diameter of the image adjustment roll 23 is set smaller than a radius of the driving roll 22. In addition, a sheet transporting face, which is a face to adsorb and transport the sheet P after being secondarily transferred to the secondary transfer belt 21 is formed by the driving roll 22 and the image adjustment roll 23.

Further, a bearing portion 73O is provided on the outer side of the image adjustment roll axis 23*a* and a bearing portion 73I on the inner side thereof. Furthermore, the bearing portion 73O on the outer side is inserted into an elongate hole 83O provided on the side plate 210 of the outer side and the bearing portion 73I on the inner side is inserted into an elongate hole 83I provided on the side plate 220 of the inner side, respectively. These elongate holes 83O and 83I have a longitudinal shape in a direction along the sheet transporting face. Accordingly, the image adjustment roll 23 is movable in a direction along the sheet transporting face.

The belt adjustment roll 24 is provided on the downstream side of the image adjustment roll 23 and on the upstream side of the driving roll 22 in the direction of rotation C of the secondary transfer belt 21. Further, as shown in FIG. 3A, the belt adjustment roll 24 is provided on the left side of the image adjustment roll 23 (bottom side of the image adjustment roll 23 in a state attached to the image forming apparatus 1 shown in FIG. 1) when viewing from the outer side. Furthermore, in the present exemplary embodiment, a diameter of the belt adjustment roll 24 is set substantially the same as a diameter of the image adjustment roll 23. A sheet peeling off face is formed on the secondary transfer belt 21 by the image adjustment roll 23 and the belt adjustment roll 24, and a non-sheet transporting face is formed on the secondary transfer belt 21 by the belt adjustment roll 24 and the driving roll 22.

Further, a bearing portion 74O is provided on the outer side of the belt adjustment roll axis 24*a* and a bearing portion 74I on the inner side thereof. Furthermore, the bearing portion 74O on the outer side is inserted into an elongate hole 84O provided on the side plate 210 of the outer side and the bearing portion 74I on the inner side is inserted into an elongate hole 84I provided on the side plate 220 of the inner side, respectively. These elongate holes 84O and 84I have a longitudinal shape in a direction along the non-sheet transporting face. Accordingly, the belt adjustment roll 24 is movable in a direction along the non-sheet transporting face.

Note that in the present exemplary embodiment, as shown in FIGS. 3A and 3B, the image adjustment roll 23 and the belt adjustment roll 24 are arranged relative to the driving roll 22 so that the sheet transporting face formed on the secondary transfer belt 21 by the driving roll 22 and the image adjustment roll 23, and the non-sheet transporting face formed on the secondary transfer belt 21 by the belt adjustment roll 24 and the driving roll 22 are substantially parallel. Further, as described above, the directions of two elongate holes are provided along the sheet transporting face and the non-sheet transporting face respectively. Thus, even if the image adjustment roll 23 and the belt adjustment roll 24 are moved along the elongate holes respectively, a parallel state between the sheet transporting face and the non-sheet transporting face is maintained.

Next, a cam mechanism which is used to move the image adjustment roll 23 and the belt adjustment roll 24, and functions as a moving member and a setting member will be described.

As shown in FIG. 2, the secondary transfer unit 20 further includes a cam axis 25*a* that configures the cam mechanism, and an outer side cam 25 and an inner side cam 26 attached to the outer side and the inner side of the cam axis 25*a*, respectively.

The cam axis 25*a* is provided substantially parallel to the driving roll axis 22*a*, and is provided between the driving roll axis 22*a* and the image adjustment roll axis 23*a* as well as the belt adjustment roll axis 24*a*. The cam axis 25*a* in the present exemplary embodiment is arranged substantially on a line of a vertical bisector (reference line S described later) formed by the image adjustment roll axis 23*a* and the belt adjustment roll axis 24*a* as apparent from FIGS. 3A and 3B. Further, as shown in FIG. 2, the cam axis 25*a* is held by penetrating through the side plate 210 of the outer side and the side plate 220 of the inner side. Furthermore, in the secondary transfer unit 20, the outer side cam 25 is attached outside relative to the side plate 210 of the outer side and the inner side cam 26 is attached outside relative to the side plate 220 of the inner side.

As described above, one end side of the outer side cam 25 is fixed on one end portion of the outer side of the cam axis 25*a*, and an outer side cam face 25F (an outer circumference face) having a curved surface of a fan shape is provided on the other end side. Further, the outer side cam face 25F is configured so as to be brought into contact with the bearing portion 73O on the outer side of the image adjustment roll 23 and the bearing portion 74O on the outer side of the belt adjustment roll 24, respectively.

On the other hand, one end side of the inner side cam 26 is fixed on the inner side of the cam axis 25*a*, and an inner side cam face 26F (another outer circumference face) having a curved surface of a fan shape is provided on the other end side. Further, the inner side cam face 26F is configured so as to be brought into contact with the bearing portion 73I on the inner side of the image adjustment roll 23 and the bearing portion 74I on the inner side of the belt adjustment roll 24, respectively.

A driving mechanism (not shown in the figure) is connected to the end portion on the inner side of the cam axis 25*a*. The cam axis 25*a* is subjected to rotation force by this driving mechanism, so that the outer side cam 25 and the inner side cam 26 fixed on the cam axis 25*a* are rotated in the same direction.

Figure 4B:
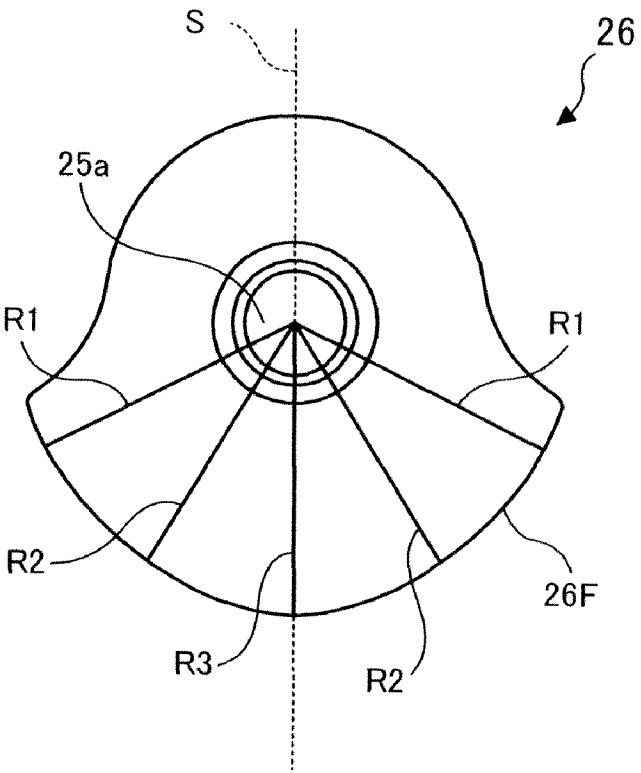
FIGS. 4A and 4B are diagrams that illustrate a shape of the outer side cam and the inner side cam.
Figure 4A:
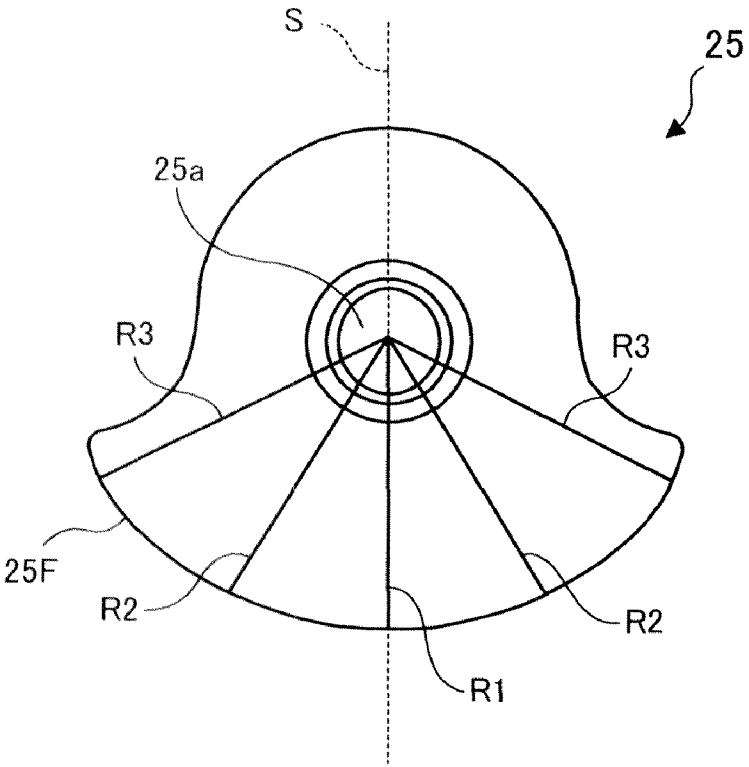

FIGS. 4A and 4B are diagrams that illustrate a shape of the outer side cam 25 and the inner side cam 26. Note that in FIGS. 4A and 4E, in order to illustrate the shape of the outer side cam face 25F and the inner side cam face 26F, reference lines S are respectively shown.

First, referring to FIG. 4A, the shape of the outer side cam 25 will be described. The outer side cam 25 has an axisymmetric shape relative to the reference line S as an axis. In the outer side cam 25, a distance between the center of the cam axis 25*a* and the outer side cam face 25F (hereinafter, referred to as a cam radius) becomes longer, as the angle relative to the reference line S about the cam axis 25*a* becomes larger.

Specifically, as shown in FIG. 4A, the cam radius is a first radius R1 that is a minimum cam radius of the outer side cam 25 on the reference line S. As the angle relative to the reference line S is increased clockwise or counterclockwise, the cam radius becomes a third radius R3 that is a maximum cam radius of the outer side cam 25. Further, between a position where the cam radius is the first radius R1 and a position where the cam radius is the third radius R3, a position where the cam radius is a second radius R2 to be utilized in the reference state which will be described later is axisymmetrically provided on both the left side and the right side of the outer side cam 25 relative to the reference line S as an axis.

The bearing portion 73O on the outer side of the image adjustment roll 23 is provided so as to be brought into contact with an area on the right side of the reference line S on the outer side cam face 25F shown in FIG. 4A. On the other hand, the bearing portion 74O on the outer side of the belt adjustment roll 24 is provided so as to be brought into contact with an area on the left side of the reference line S on the outer side cam face 25F. Thus, in response to a rotation angle of the cam axis 25*a*, the bearing portion 73O of the image adjustment roll 23 may be brought into contact with any position in the area on the right side of the outer side cam face 25F and the bearing portion 74O of the belt adjustment roll 24 may be brought into contact with any position in the area on the left side. Further, since the bearing portions on the outer side of the image adjustment roll 23 and the belt adjustment roll 24 are brought into contact with the outer side cam face 25F respectively, these two rolls are simultaneously adjusted in association with the rotation of the cam axis 25*a*.

Next, referring to FIG. 4B, a shape of the inner side cam 26 will be described.

Similarly to the outer side cam 25, the inner side cam 26 has a symmetric shape relative to the reference line S as an axis. However, the inner side cam 26 is different in shape as compared with the outer side cam 25. Described specifically, a cam radius of the inner side cam 26 becomes shorter, as the angle relative to the reference line S about the cam axis 25*a* becomes larger.

Specifically, as shown in FIG. 4B, the cam radius is the third radius R3 that is a maximum cam radius of the inner side cam 26 on the reference line S. As an angle relative to the reference line S is increased clockwise or counterclockwise, the cam radius becomes the first radius R1 that is a minimum cam radius of the inner side cam 26. Further, similarly to the outer side cam 25, between a position where the cam radius is the third radius R3 and a position where the cam radius is the first radius R1, a position where the cam radius is the second radius R2 to be utilized in the reference state which will be described later is axisymmetrically provided on both the left side and the right side of the inner side cam 26 relative to the reference line S as an axis.

The bearing portion 73I on the inner side of the image adjustment roll 23 is provided so as to be brought into contact with an area on the left side of the reference line S on the inner side cam face 26F shown in FIG. 4B. On the other hand, the bearing portion 74I on the inner side of the belt adjustment roll 24 is provided so as to be brought into contact with an area on the right side of the reference line S on the inner side cam face 26F. Thus, in response to a rotation angle of the cam axis 25*a*, the bearing portion 73I of the image adjustment roll 23 may be brought into contact with any position in the area on the left side of the inner side cam face 26F and the bearing portion 74I of the belt adjustment roll 24 may be brought into contact with any position in the area on the left side. Further, since the bearing portions on the inner side of the image adjustment roll 23 and the belt adjustment roll 24 are brought into contact with the inner side cam face 26F respectively, these two rolls are simultaneously adjusted in association with the rotation of the cam axis 25*a*.

The outer side cam 25 and the inner side cam 26 are fixed on the outer side and the inner side of the same cam axis 25*a* respectively as described above. At this time, the outer side cam 25 and the inner side cam 26 are oppositely attached so that each reference line S is aligned. Accordingly, the position where the cam radius is the first radius R1 in the outer side cam 25 and the position where the cam radius is the third radius R3 in the inner side cam 26 are opposed. Further, the position where the cam radius is the third radius R3 in the outer side cam 25 and the position where the cam radius is the first radius R1 in the inner side cam 26 are opposed. Furthermore, the position where the cam radius is the second radius R2 in the outer side cam 25 and the position where the cam radius is the second radius R2 in the inner side cam 26 are opposed.

In this way, the outer side cam 25 and the inner side cam 26 are opposed in the position where the cam radius is the second radius R2. However, the outer side cam 25 and the inner side cam 26 are oppositely arranged so that, as one cam radius is increased, another cam radius is decreased.

Note that a cam radius between a rotation center of the outer side cam 25 and a contact region of the image adjustment roll 23 on the outer side cam face 25F configures a first distance, and a cam radius between a rotation center of the outer side cam 25 and a contact region of the belt adjustment roll 24 on the outer side cam face 25F configures a second distance. Further, a cam radius between a rotation center of the inner side cam 26 and a contact region of the image adjustment roll 23 on the inner side cam face 26F configures a third distance, and a cam radius between a rotation center of the inner side cam 26 and a contact region of the belt adjustment roll 24 on the inner side cam face 26F configures a fourth distance.

Next, the reference state of the secondary transfer unit 20 will be described.

Note that, in the following description, as shown in FIG. 3A, on the outer side, a center distance between the driving roll axis 22*a* and the image adjustment roll axis 23*a* along the sheet transporting face is referred to as a first outer side center distance LO1, a center distance between the driving roll axis 22*a* and the belt adjustment roll axis 24*a* along the non-sheet transporting face is referred to as a second outer side center distance LO2, and further a center distance between the image adjustment roll axis 23*a* and the belt adjustment roll axis 24*a* along the sheet peeling off face is referred to as a third outer side center distance LO3.

Furthermore, as shown in FIG. 3B, on the inner side, a center distance between the driving roll axis 22*a* and the image adjustment roll axis 23*a* along the sheet transporting face is referred to as a first inner side center distance LI1, and a center distance between the driving roll axis 22*a* and the belt adjustment roll axis 24*a* along the non-sheet transporting face is referred to as a second inner side center distance LI2, and further a center distance between the image adjustment roll axis 23*a* and the belt adjustment roll axis 24*a* along the sheet peeling off face is referred to as a third inner side center distance LI3.

In the reference state, as shown in FIG. 3A, in the outer side cam 25, the bearing portion 73O of the image adjustment roll 23 and the bearing portion 74O of the belt adjustment roll 24 are respectively brought into contact with the position where the cam radius is the second radius R2. On the other hand, as shown in FIG. 3B, in the inner side cam 26, the bearing portion 73I of the image adjustment roll 23 and the bearing portion 74I of the belt adjustment roll 24 are respectively brought into contact with the position where the cam radius is the second radius R2.

Accordingly, in the reference state, all bearing portions on the inner and the outer sides of the image adjustment roll 23, and all bearing portions on the inner and the outer sides of the belt adjustment roll 24 are brought into contact with a position where the cam radius on the outer side cam face 25F or the inner side cam face 26F is the second radius R2.

Thus, all the first outer side center distance LO1, the second outer side center distance LO2, the first inner side center distance LI1, and the second inner side center distance LI2 are equal (LO1=LO2=LI1=LI2). Further, since the image adjustment roll 23 and the belt adjustment roll 24 are parallel, the third outer side center distance LO3 and the third inner side center distance LI3 are also equal (LO3=LI3).

Here, the sum of the respective center distances on the outer side of the secondary transfer belt 21 (LO1+LO2+LO3) is substantially equal to the sum of the respective center distances on the inner side thereof (LI1+LI2+LI3) according to the above-described relation. Therefore, in the secondary transfer belt 21 that is wrapped in a state of the above-described center distances, a circumference of the secondary transfer unit 20 (hereinafter, referred to as the circumference) on the inner side is equal to that on the outer side.

In this way, since the circumference of the secondary transfer belt 21 on the outer side is equal to that on the inner side, and the driving roll 22, the image adjustment roll 23 and the belt adjustment roll 24 are reciprocally in a sate of a substantially parallel, the meanders of the secondary transfer belt 21 hardly occur.

Figure 5:
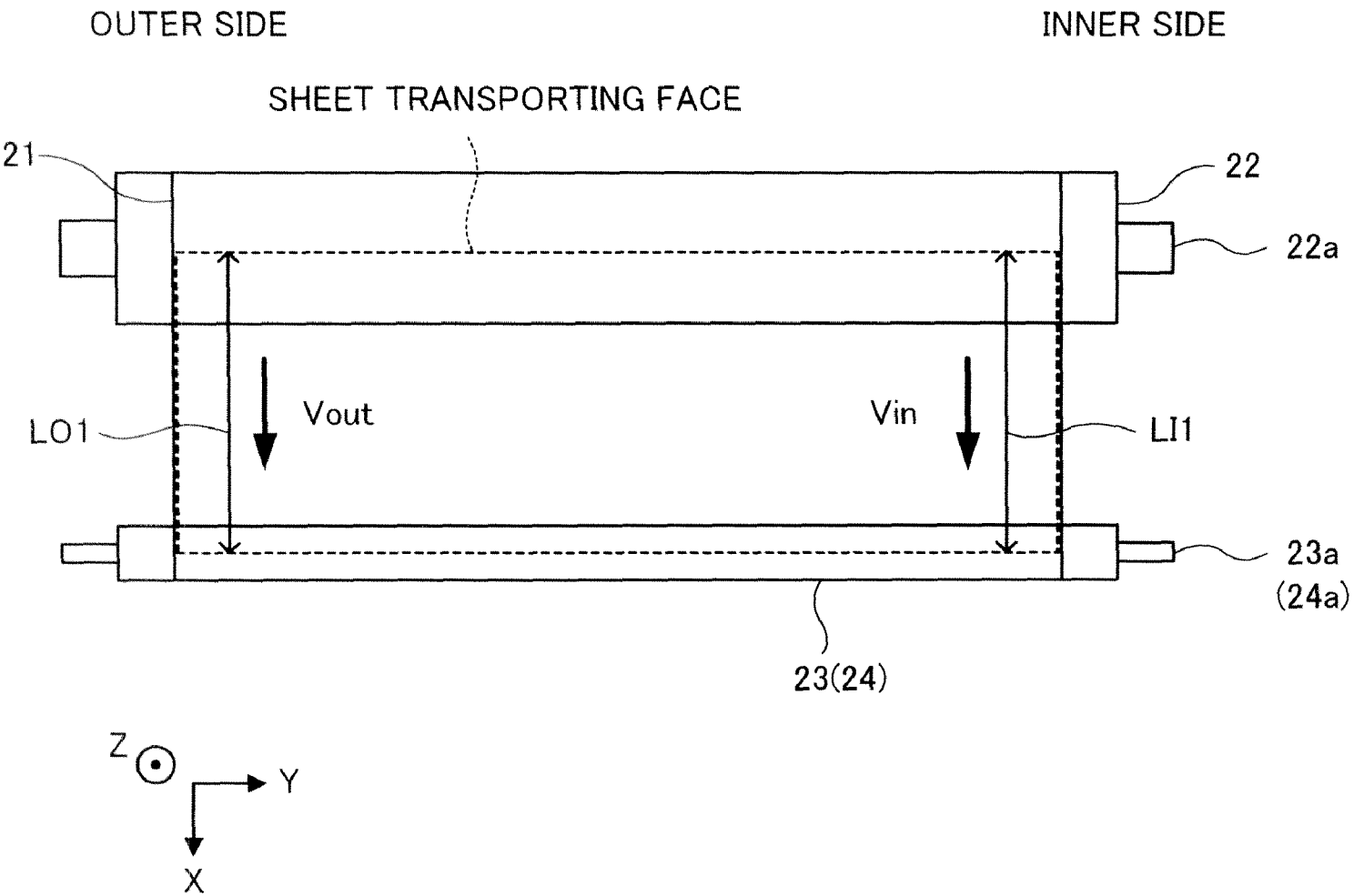
FIG. 5 is a diagram that illustrates a surface velocity of the secondary transfer belt in the reference state.

FIG. 5 is a diagram that Illustrates a surface velocity of the secondary transfer belt 21 in the reference state.

As described above, in the reference state, the first outer side center distance LO1 is equal to the first inner side center distance LI1, on the sheet transporting face. Thus, as shown in FIG. 5, since a distance where the secondary transfer belt 21 proceeds per unit time between the axes of the driving roll 22 and the image adjustment roll 23 is the same amount on the outer side and the inner side, the surface velocity (moving speed) of the secondary transfer belt 21 is substantially equal on the outer side $V_{out}$ to that on the inner side $V_{in}$.

Accordingly, if position accuracy of the components of each unit such as the secondary transfer unit 20 that configures an image forming apparatus is equal on the inner side to that on the outer side, when secondary transfer is performed in the reference state, an image on the outer side has a substantially similar length to an image on the inner side.

FIGS. 6A and 6B are diagrams for explaining motions in the secondary transfer unit 20 when the image on the outer side is elongated. Elongation of the image on the outer side is executed in the case where the outer side of the image is reduced, in comparison with the inner side, when secondary transfer is performed in the above-described reference state.

Note that, as described above, in response to the rotation angle of the cam axis 25*a*, the bearing portions of the image adjustment roll 23 and the belt adjustment roll 24 may be brought into contact with any position relative to the outer side cam face 25F and the inner side cam face 26F. In the following, a description will be given of an adjustment of the image adjustment roll 23 and the belt adjustment roll 24 by a cam mechanism when the amount of movement of these rolls is maximized, as an example.

When the image on the outer side is elongated, the cam axis 25*a* in the reference state is rotated to a direction same as the direction of rotation C of the secondary transfer belt 21. At this time, the outer side cam 25 is rotated clockwise as shown in FIG. 6A and the inner side cam 26 is rotated counterclockwise as shown in FIG. 6B.

Then, on the outer side cam face 25F, the bearing portion 73O of the image adjustment roll 23 is brought into contact with a position where the cam radius is the third radius R3 and the bearing portion 74O of the belt adjustment roll 24 is brought into contact with a position where the cam radius is the first radius R1.

As a result of this, since the bearing portion 73O on the outer side of the image adjustment roll 23 is brought into contact with a position on the outer side cam face 25F where the cam radius is increased from that in the reference state from R2 to R3), the distance from the cam axis 25*a* is also increased and the bearing portion 73O is moved in a direction leaving from the driving roll 22.

On the other hand, since the bearing portion 74O on the outer side of the belt adjustment roll 24 is brought into contact with a position on the outer side cam face 25F where the cam radius is decreased from that in the reference state (from R2 to R1), the distance from the cam axis 25*a* is also decreased and the bearing portion 74O is moved in a direction approaching to the driving roll 22 by tensile force of the secondary transfer belt 21.

Interlocking with the outer side cam 25, in the inner side cam 26, the bearing portion 73I of the image adjustment roll 23 is brought into contact with a position on the inner side cam face 26F where the cam radius is the first radius R1 and the bearing portion 74I of the belt adjustment roll 24 is brought into contact with a position on the inner side cam face 26F where the cam radius is the third radius R3.

As a result of this, since the bearing portion 73I on the inner side of the image adjustment roll 23 is brought into contact with a position on the inner side cam face 26F where the cam radius is decreased from that in the reference state (from R2 to R1), the distance from the cam axis 25*a* is decreased and the bearing portion 73I is moved in a direction approaching to the driving roll 22 by the tensile force of the secondary transfer belt 21.

On the other hand, since the bearing portion 74I on the inner side of the belt adjustment roll 24 is brought into contact with a position on the inner side cam face 26F where the cam radius is increased from that in the reference state (from R2 to R3), the bearing portion 74I is moved in a direction leaving from the driving roll 22.

In this way, since the outer side cam 25 has an axisymmetric shape as described above, an end portion on the outer side of the image adjustment roll 23 and an end portion on the outer side of the belt adjustment roll 24 are oppositely moved forward and backward each other, relative to an end portion on the outer side of the driving roll 22. Similarly, since the inner side cam 26 has an axisymmetric shape as described above, an end portion on the inner side of the image adjustment roll 23 and an end portion on the inner side of the belt adjustment roll 24 are oppositely moved forward and backward each other, relative to an end portion on the inner side of the driving roll 22.

Further, in the outer side cam 25 and the inner side cam 26, since the relation between an increase and a decrease of the cam radius is opposite, if one end side of the image adjustment roll 23 or the belt adjustment roll 24 approaches the driving roll 22, the other end side is moved so as to leave from the driving roll 22.

As a result of this, the first outer side center distance LO1 is increased in comparison with that in the reference state and the second outer side center distance LO2 is decreased in comparison with that in the reference state. Further, the first inner side center distance LI1 is decreased in comparison with that in the reference state and the second inner side center distance LI2 is increased in comparison with that in the reference state.

Figure 7:
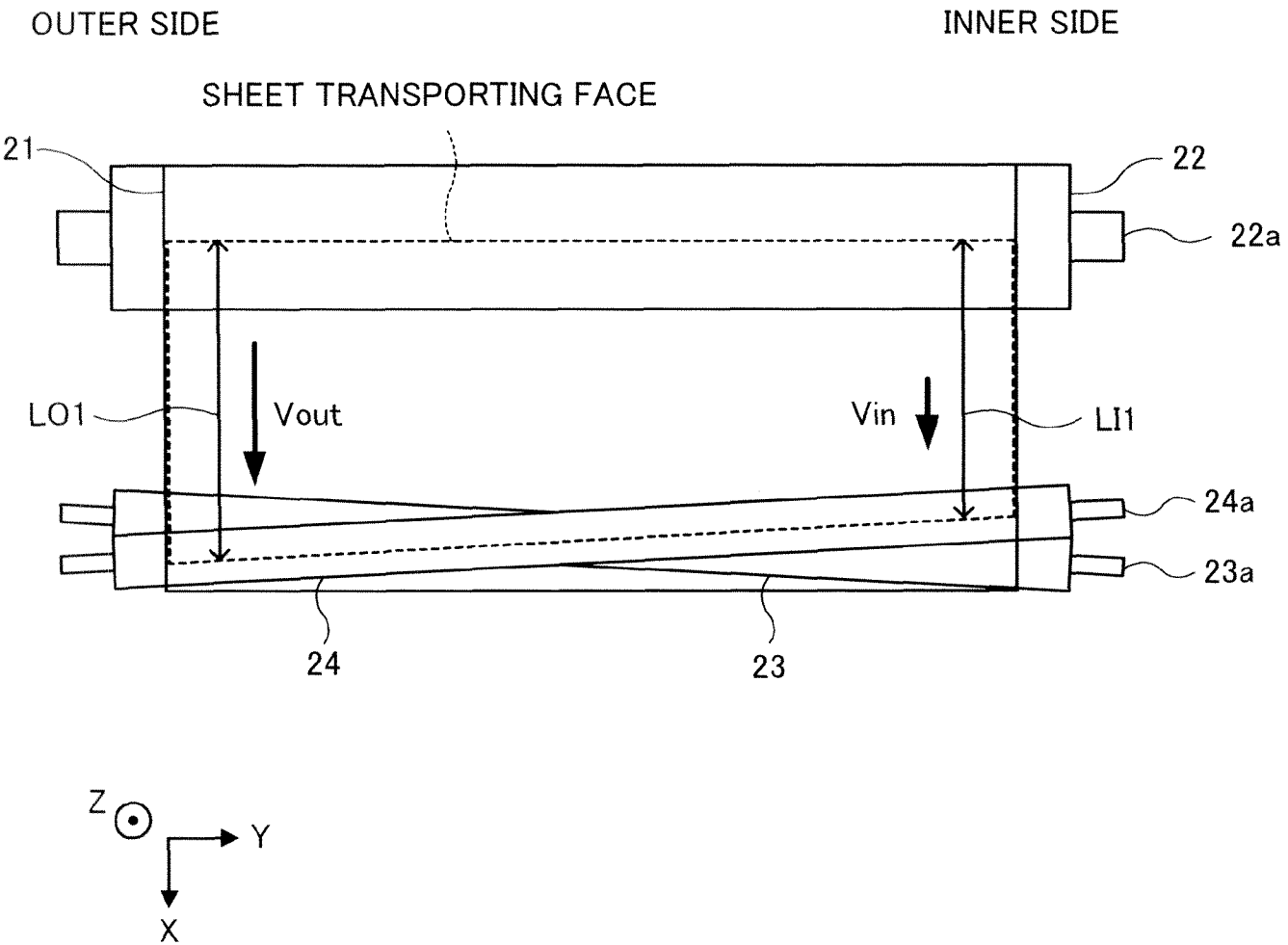
FIG. 7 is a diagram for explaining the surface velocity of the secondary transfer belt when the image on the outer side is elongated.

FIG. 7 is a diagram for explaining the surface velocity of the secondary transfer belt 21 when the image on the outer side is elongated.

Here, in the secondary transfer belt 21, if the center distances of the rolls over which the secondary transfer belt 21 is wrapped are different between the outer side and the inner side, since the distance when the secondary transfer belt 21 proceeds per unit time becomes longer for the longer center distance, the surface velocity of the secondary transfer belt 21 becomes fast. On the contrary, since the distance when the secondary transfer belt 21 proceeds per unit time becomes shorter for the shorter center distance, the surface velocity of the secondary transfer belt 21 becomes slow.

Accordingly, in a state shown in FIG. 7, the surface velocity $V_{out}$ on the outer side on the sheet transporting face of the secondary transfer belt 21 is increased in comparison with the surface velocity $V_{in}$ on the inner side. Thus, when a toner image is secondarily transferred on the sheet transporting face of the secondary transfer belt 21, the image on the outer side is elongated and the image on the inner side is shortened.

Note that on the non-sheet transporting face, since the relation between center distances is opposite to that on the sheet transporting face, the surface velocity $V_{out}$ on the outer side is decreased as compared with the surface velocity $V_{in}$ on the inner side (not shown in the figure). Thus, an average speed (time spent on one round) of the secondary transfer belt 21 on the outer side is equal to that on the inner side.

Further, as shown in FIGS. 6A and 6B, on the outer side cam face 25F or the inner side cam face 26F, the bearing portion 73O of the image adjustment roll 23 on the outer side and the bearing portion 74I of the belt adjustment roll 24 on the inner side are brought into contact with a position where the cam radius is the third radius R3. Thus, the first outer side center distance LO1 is equal to the second inner side center distance LI2. (LO1=LI2)

On the other hand, as shown in FIG. 6B, on the outer side cam face 25F or the inner side cam face 26F, the bearing portion 74O of the belt adjustment roll 24 on the outer side and the bearing portion 73I of the image adjustment roll 23 on the inner side are brought into contact with a position where the cam radius is the first radius R1. Thus, the second outer side center distance LO2 is equal to the first inner side center distance LI1. (LO2=LI1)

Further, the third outer side center distance LO3 is equal to the third inner side center distance LI3, since the image adjustment roll 23 and the belt adjustment roll 24 are symmetrically moved. (LO3=LI3)

The sum of the respective center distances on the outer side of the secondary transfer belt 21 (LO1+LO2+LO3) is equal to the sum of the respective center distances on the inner side (LI1+LI2+LI3) according to the above-described relation. Accordingly, in a state when the respective rolls have the above-described center distances, the circumference of the secondary transfer belt 21 that is wrapped over these rolls on the inner side is equal to that on the outer side.

Further, as described above, in order to elongate the image on the outer side, the image adjustment roll 23 is made oblique relative to the driving roll 22. Since the image adjustment roll 23 is thus oblique relative to the driving roll 22, force to cause meander in the secondary transfer belt 21 is generated. However, interlocking with the image adjustment roll 23, since the belt adjustment roll 24 is made oblique in the opposite direction to that of the image adjustment roll 23, relative to the driving roll 22, the force in the secondary transfer belt 21 which causes meanders described above is offset.

As described above, the circumference of the secondary transfer belt 21 on the outer side is equal to that on the inner side and the force which causes the secondary transfer belt 21 to attempt meander is offset. Accordingly, occurrence of meanders in the secondary transfer belt 21 is suppressed.

FIGS. 8A and 8B are diagrams for explaining motions in the secondary transfer unit 20 when the image on the inner side is elongated. Elongation of the image on the inner side is executed in the case where the inner side of the image is reduced, in comparison with the outer side, when the secondary transfer is performed in the reference state.

Note that, as described above, in response to the rotation angle of the cam axis 25*a*, the bearing portions of the image adjustment roll 23 and the belt adjustment roll 24 may be brought into contact with any position relative to the outer side cam face 25F and the inner side cam face 26F. In the following, a description will be given of an adjustment of the image adjustment roll 23 and the belt adjustment roll 24 by a cam mechanism when the amount of movement of these rolls is maximized, as an example.

When the image on the inner side is elongated, the cam axis 25*a* in the reference state is rotated to an opposite direction to the direction of rotation C of the secondary transfer belt 21. At this time, the outer side cam 25 is rotated counterclockwise as shown in FIG. 8A and the inner side cam 26 is rotated clockwise as shown in FIG. 8B.

Then, on the outer side cam face 25F, the bearing portion 73O of the image adjustment roll 23 is brought into contact with a position where the cam radius is the first radius R1 and the bearing portion 74O of the belt adjustment roll 24 is brought into contact with a position where the cam radius is the third radius R3.

As a result of this, since the bearing portion 73O on the outer side of the image adjustment roll 23 is brought into contact with a position on the outer side cam face 25F where the cam radius is decreased from that in the reference state (from R2 to R1), the distance from the cam axis 25*a* is also decreased and the bearing portion 73O is moved in a direction approaching to the driving roll 22 by tensile force of the secondary transfer belt 21.

On the other hand, since the bearing portion 74O on the outer side of the belt adjustment roll 24 is brought into contact with a position on the outer side cam face 25F where the cam radius is increased from that in the reference state (from R2 to R3), the distance from the cam axis 25*a* is also increased and the bearing portion 74O is moved in a direction leaving from the driving roll 22.

Interlocking with the outer side cam 25, in the inner side cam 26, the bearing portion 73I of the image adjustment roll 23 is brought into contact with a position on the inner side cam face 26F where the cam radius is the third radius R3 and the bearing portion 74I of the belt adjustment roll 24 is brought into contact with a position on the inner side cam face 26F where the cam radius is the first radius R1.

As a result of this, since the bearing portion 73I on the inner side of the image adjustment roll 23 is brought into contact with a position on the inner side cam face 26F where the cam radius is increased from that in the reference state (from R2 to R3), the distance from the cam axis 25*a* is increased and the bearing portion 731 is moved in a direction leaving from the secondary transfer belt 21.

On the other hand, since the bearing portion 74I on the inner side of the belt adjustment roll 24 is brought into contact with a position on the inner side cam face 26F where the cam radius is decreased from that in the reference state (from R2 to R1), the bearing portion 74I is moved in a direction approaching to the driving roll 22 by tensile force of the secondary transfer belt 21.

In this way, in the case where the inner side is elongated, since the outer side cam 25 has an axisymmetric shape as described above, an end portion on the outer side of the image adjustment roll 23 and an end portion on the outer side of the belt adjustment roll 24 are oppositely moved forward and backward each other, relative to an end portion on the outer side of the driving roll 22, similarly to the case where the outer side is elongated. Similarly, since the inner side cam 26 has an axisymmetric shape as described above, an end portion on the inner side of the image adjustment roll 23 and an end portion on the inner side of the belt adjustment roll 24 are oppositely moved forward and backward each other, relative to an end portion on the inner side of the driving roll 22.

Further, in the outer side cam 25 and the inner side cam 26, since the relation between an increase and a decrease of the cam radius is opposite, if one end side of the image adjustment roll 23 or the belt adjustment roll 24 approaches the driving roll 22, the other end side is moved so as to leave from the driving roll 22.

As a result of this, the first outer side center distance LO1 is decreased in comparison with that in the reference state and the second outer side center distance LO2 is increased in comparison with that in the reference state. Further, the first inner side center distance LI1 is increased in comparison with that in the reference state and the second inner side center distance LI2 is decreased in comparison with that in the reference state.

Figure 9:
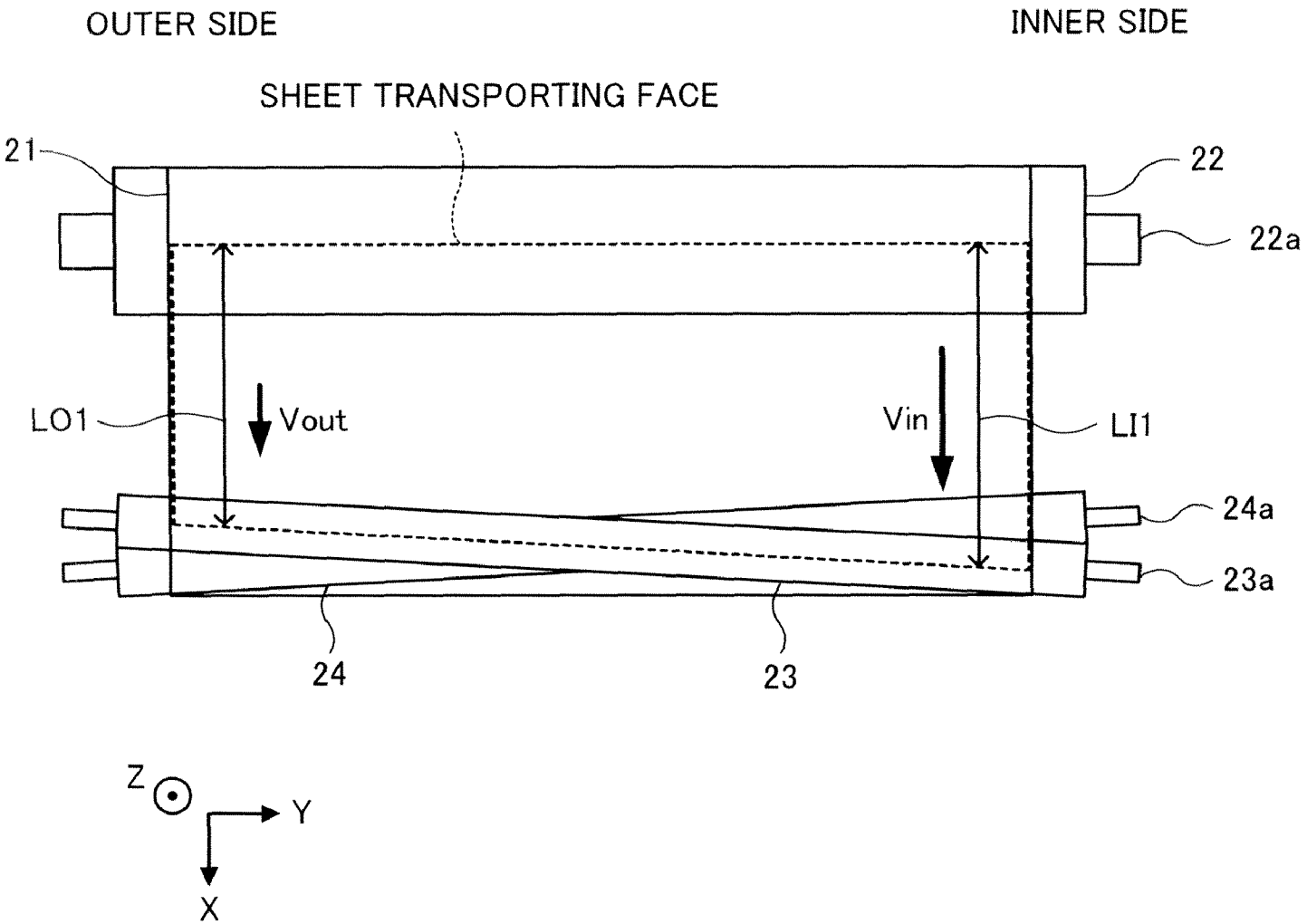
FIG. 9 is a diagram for explaining the surface velocity of the secondary transfer belt when the image on the inner side is elongated.

FIG. 9 is a diagram for explaining the surface velocity of the secondary transfer belt 21 when the image on the inner side is elongated.

In a state shown in FIG. 9, the surface velocity $V_{in}$ on the inner side on the sheet transporting face of the secondary transfer belt 21 is increased in comparison with the surface velocity $V_{out}$ on the outer side. Thus, when a toner image is secondarily transferred on the sheet transporting face of the secondary transfer belt 21, the image on the inner side is elongated and the image on the outer side is shortened.

Note that, on the non-sheet transporting face, since the relation between center distances is opposite to that on the sheet transporting face, the surface velocity $V_{in}$ on the inner side is decreased in comparison with the surface velocity $V_{out}$ on the outer side (not shown in the figure). Thus, an average speed (time spent on one round) of the secondary transfer belt 21 on the outer side is equal to that on the inner side.

Further, as shown in FIGS. 8A and 8B, on the outer side cam face 25F or the inner side cam face 26F, the bearing portion 73O of the image adjustment roll 23 on the outer side and the bearing portion 74I of the belt adjustment roll 24 on the inner side are brought into contact with a position where the cam radius is the first radius R1. Thus, the first outer side center distance LO1 is equal to the second inner side center distance LI2. (LO1=LI2)

On the other hand, as shown in FIG. 8B, on the outer side cam face 25F or the inner side cam face 26F, the bearing portion 74O of the belt adjustment roll 24 on the outer side and the bearing portion 73I of the image adjustment roll 23 on the inner side are brought into contact with a position where the cam radius is the third radius R3. Thus, the second outer side center distance LO2 is equal to the first inner side center distance LI1. (LO2=LI1)

Further, the third outer side center distance LO3 is equal to the third inner side center distance LI3, since the image adjustment roll 23 and the belt adjustment roll 24 are symmetrically moved. (LO3=LI3)

Similarly, in the case where the image of the inner side is elongated, the sum of the respective center distances on the outer side of the secondary transfer belt 21 (LO1+LO2+LO3) is equal to the sum of the respective center distances on the inner side (LI1+LI2+LI3) according to the above-described relation. Accordingly, in a state when the respective rolls have the above-described center distances, the circumference of the secondary transfer belt 21 that is wrapped over these rolls on the inner side is equal to that on the outer side.

Further, as described above, in order to elongate the image on the inner side, the image adjustment roll 23 is made oblique relative to the driving roll 22. Since the image adjustment roll 23 is thus oblique relative to the driving roll 22, force to cause meander in the secondary transfer belt 21 is generated. However, interlocking with the image adjustment roll 23, since the belt adjustment roll 24 is made oblique in the opposite direction to that of the image adjustment roll 23, relative to the driving roll 22, the force in the secondary transfer belt 21 which causes meanders is offset.

As described above, the circumference of the secondary transfer belt 21 on the outer side is equal to that on the inner side and the force which causes the secondary transfer belt 21 to attempt meander is offset. Accordingly, occurrence of meanders in the secondary transfer belt 21 is suppressed.

Note that, by using the secondary transfer belt 21 in the present exemplary embodiment, the image adjustment may be carried out even when, for example, an elongation or reduction occurs on the inner side and the outer side of an image by factors of the secondary transfer unit 20 itself, or when a toner image is transported in a different state from an originally intended image between the outer side and the inner side in the intermediate transfer belt 15.

Further, shapes of the outer side cam 25 and the inner side cam 26 are not limited to the shape illustrated in the present exemplary embodiment. The shapes of the cam may be changed suitably by the relation of positions between the image adjustment roll 23 and the driving roll 22 and between the belt adjustment roll 24 and the driving roll 22.

Furthermore, the number of roll members is not limited to three. Meanders of belt that occur when a difference in elongation and reduction of an image is adjusted by changing a center distance between the driving roll and the image adjustment roll may be suppressed using plural belt adjustment rolls.

In addition, in the present exemplary embodiment, a transfer position is formed by opposing the secondary transfer unit 20 to the intermediate transfer belt 15, but it is not limited to this. For example, there is also considered a case where the transfer position is formed by opposing a drum-shaped photoconductor or a belt-shaped photoconductor on a transfer belt (secondary transfer unit 20). Even in such a case, by using the secondary transfer unit 20 described in the present exemplary embodiment, the image adjustment may be carried out as well as the meanders of the belt may be suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that holds an image;

a transfer belt that is rotated while a recording medium is sandwiched between the transfer belt and the image carrier, and transfers the image held by the image carrier to the recording medium, the transfer belt including a first end side and a second end side;

a first roll member that holds the transfer belt and brings the transfer belt into contact with the image carrier;

a second roll member that holds the transfer belt together with the first roll member;

a third roll member that holds the transfer belt together with the first roll member and the second roll member; and a moving member that is in contact with the second roll member and the third roll member, that makes the second roll member movable so as to make a center distance between the first roll member and the second roll member larger on the first end side of the transfer belt than the center distance on the second end side by changing a position where the moving member and the second roll member contact, and makes the third roll member movable so as to make a center distance between the first roll member and the third roll member smaller on the first end side than the center distance on the second end side by changing a position where the moving member and the third roll member contact.

2. The image forming apparatus according to claim 1, wherein the moving member further makes the second roll member movable so as to make the center distance between the first roll member and the second roll member smaller on the first end side than the center distance on the second end side, and makes the third roll member movable so as to make the center distance between the first roll member and the third roll member larger on the first end side than the center distance on the second end side.

3. The image forming apparatus according to claim 2, wherein the moving member includes a cam that is rotatably attached to the first end side of the transfer belt relative to an axis as a center and has an outer circumference face being in contact with the second roll member and the third roll member, and the outer circumference face of the cam has a shape in which a second distance between the center and a contact region with the third roll member is increased when a first distance between the center and a contact region with the second roll member is decreased in association with a rotation of the cam, and in which the second distance is decreased when the first distance is increased in association with the rotation of the cam.

4. The image forming apparatus according to claim 3, wherein the moving member further includes: another cam that is rotatably attached to the second end side of the transfer belt relative to an axis as a center and has another outer circumference face being in contact with the second roll member and the third roll member; and a cam axis that fixes and supports the axis of the cam and the axis of another cam, and rotates the cam and another cam in the same direction, another outer circumference face has a shape in which a fourth distance between the center and a contact region with the third roll member is increased when a third distance between the center and a contact region with the second roll member is decreased in association with a rotation of another cam, and the fourth distance is decreased when the third distance is increased in association with the rotation of another cam, and the cam axis supports the second roll member and the third roll member so as to decrease the third distance when the first distance is increased and decrease the fourth distance when the second distance is increased.

5. The image forming apparatus according to claim 2, wherein the moving member further makes the second roll member and the third roll member movable so that the center distance between the first roll member and the second roll member on the first end side substantially equal to the center distance between the first roll member and the third roll member on the second end side.

6. The image forming apparatus according to claim 1, wherein the moving member makes the second roll member and the third roll member movable so as to make a circumference on the first end side of the transfer belt substantially equal to a circumference on the second end side of the transfer belt.

7. The image forming apparatus according to claim 1, wherein the second roll member is provided on the downstream side in a direction of a rotation of the transfer belt relative to the first roll member, and the second roll member is movable along a face formed on the transfer belt by the first roll member and the second roll member.

8. The image forming apparatus according to claim 7, wherein the third roll member is provided on the downstream side in a direction of the rotation of the transfer belt relative to the second roll member and on the upstream side in a direction of the rotation of the transfer belt relative to the first roll member, and the third roll member is movable along a face formed on the transfer belt by the third roll member and the first roll member.

9. An image forming apparatus comprising:

an image carrier that holds an image;

a transfer belt that is rotated while a recording medium is sandwiched between the transfer belt and the image carrier, and transfers the image held by the image carrier to the recording medium, the transfer belt including a first end side and a second end side;

a first roll member that holds the transfer belt and brings the transfer belt into contact with the image carrier;

a second roll member that holds the transfer belt together with the first roll member;

a third roll member that holds the transfer belt together with the first roll member and the second roll member; and a setting member that is in contact with the second roll member and the third roll member, and is able to set a direction of an axis of the second roll member relative to an axis of the first roll member and is able to set a direction of an axis of the third roll member in a direction different from the axis of the second roll member interlocking with a setting action of the direction of the axis of the second roll member by changing a position where the setting member and the third roll member contact.

10. The image forming apparatus according to claim 9, wherein the setting member sets the direction of the axis of the third roll member in the same direction as the axis of the second roll member when the direction of the axis of the second roll member is set in the same direction as the axis of the first roll member.

11. The image forming apparatus according to claim 9, wherein the setting member sets the direction of the axis of the second roll member so that one end portion of the second roll member is leaving from the first roll member, and sets the direction of the axis of the third roll member so that an end portion of the third roll member on the same side as the one end portion is approaching to the first roll member.

12. The image forming apparatus according to claim 11, wherein the setting member sets the direction of the axis of the second roll member so that the other end portion of the second roll member is approaching to the first roll member and sets the direction of the axis of the third roll member so that an end portion of the third roll member on the same side as the other end portion is leaving from the first roll member.

13. An image forming apparatus comprising:

an image carrier that holds an image;

a transfer belt that is rotated while a recording medium is sandwiched between the transfer belt and the image carrier, and transfers the image held by the image carrier to the recording medium, the transfer belt including a first end side and a second end side;

a first roll member that holds the transfer belt and brings the transfer belt into contact with the image carrier;

a second roll member that holds the transfer belt together with the first roll member and forms a transporting face which transports the recording medium to the transfer belt together with the first roll member;

a third roll member that holds the transfer belt together with the first roll member and the second roll member, and forms a non-transporting face which does not transport the recording medium to the transfer belt together with the first roll member; and a moving member that is in contact with the second roll member and the third roll member, that makes the second roll member movable so as to make a moving speed on the first end side of the transfer belt larger than a moving speed on the second end side on the transporting face and makes the third roll member movable so as to make a moving speed on the first one end side of the transfer belt smaller than a moving speed on the second end side on the non-transporting face by changing a position where the moving member and the third roll member contact.

14. The image forming apparatus according to claim 13, wherein the moving member further makes the second roll member movable so as to make a moving speed on the first end side of the transfer belt smaller than a moving speed on the second end side on the transporting face and makes the third roll member movable so as to make a moving speed on the first end side larger than a moving speed on the second end side of the transfer belt on the non-transporting face.

15. The image forming apparatus according to claim 13, wherein the moving member makes the second roll member and the third roll member movable so as to make an average speed of the whole of the first end side of the transfer belt substantially equal to an average speed of the whole of the second end side.

16. A belt transporting apparatus comprising:

a belt that is rotated, the belt including a first end side and a second end side;

a first roll member that holds the belt;

a second roll member that holds the belt together with the first roll member;

a third roll member that holds the belt together with the first roll member and the second roll member; and a moving member that is in contact with the second roll member and the third roll member, that makes the second roll member movable so as to make a center distance between the first roll member and the second roll member larger on the first end side of the belt than the center distance on the second end side, and makes the third roll member movable so as to make a center distance between the first roll member and the third roll member smaller on the first end side than the center distance on the second end side by changing a position where the moving member and the third roll member contact.

17. The image forming apparatus according to claim 9, wherein the setting member further includes:

a cam that is rotatably attached to the first end side of the transfer belt relative to an axis as a center and has an outer circumference face being in contact with the second roll member and the third roll member, the outer circumference face of the cam has a shape in which a second distance between the center and a contact region with the third roll member is increased when a first distance between the center and a contact region with the second roll member is decreased in association with a rotation of the cam, and in which the second distance is decreased when the first distance is increased in association with the rotation of the cam, another cam that is rotatably attached to the second end side of the transfer belt relative to an axis as a center and has another outer circumference face being in contact with the second roll member and the third roll member; and a cam axis that fixes and supports the axis of the cam and the axis of another cam, and rotates the cam and another cam in the same direction, another outer circumference face has a shape in which a fourth distance between the center and a contact region with the third roll member is increased when a third distance between the center and a contact region with the second roll member is decreased in association with a rotation of another cam, and the fourth distance is decreased when the third distance is increased in association with the rotation of another cam, and the cam axis supports the second roll member and the third roll member so as to decrease the third distance when the first distance is increased and decrease the fourth distance when the second distance is increased.

18. The image forming apparatus according to claim 13, wherein the moving member further includes:

a cam that is rotatably attached to the first end side of the transfer belt relative to an axis as a center and has an outer circumference face being in contact with the second roll member and the third roll member, the outer circumference face of the cam has a shape in which a second distance between the center and a contact region with the third roll member is increased when a first distance between the center and a contact region with the second roll member is decreased in association with a rotation of the cam, and in which the second distance is decreased when the first distance is increased in association with the rotation of the cam, another cam that is rotatably attached to the second end side of the transfer belt relative to an axis as a center and has another outer circumference face being in contact with the second roll member and the third roll member; and a cam axis that fixes and supports the axis of the cam and the axis of another cam, and rotates the cam and another cam in the same direction, another outer circumference face has a shape in which a fourth distance between the center and a contact region with the third roll member is increased when a third distance between the center and a contact region with the second roll member is decreased in association with a rotation of another cam, and the fourth distance is decreased when the third distance is increased in association with the rotation of another cam, and the cam axis supports the second roll member and the third roll member so as to decrease the third distance when the first distance is increased and decrease the fourth distance when the second distance is increased.

19. The image forming apparatus according to claim 16, wherein the moving member further includes:

a cam that is rotatably attached to the first end side of the transfer belt relative to an axis as a center and has an outer circumference face being in contact with the second roll member and the third roll member, the outer circumference face of the cam has a shape in which a second distance between the center and a contact region with the third roll member is increased when a first distance between the center and a contact region with the second roll member is decreased in association with a rotation of the cam, and in which the second distance is decreased when the first distance is increased in association with the rotation of the cam, another cam that is rotatably attached to the second end side of the transfer belt relative to an axis as a center and has another outer circumference face being in contact with the second roll member and the third roll member; and a cam axis that fixes and supports the axis of the cam and the axis of another cam, and rotates the cam and another cam in the same direction, another outer circumference face has a shape in which a fourth distance between the center and a contact region with the third roll member is increased when a third distance between the center and a contact region with the second roll member is decreased in association with a rotation of another cam, and the fourth distance is decreased when the third distance is increased in association with the rotation of another cam, and the cam axis supports the second roll member and the third roll member so as to decrease the third distance when the first distance is increased and decrease the fourth distance when the second distance is increased.

* * * * *